US010022840B1

(12) United States Patent
Miess

(10) Patent No.: US 10,022,840 B1
(45) Date of Patent: Jul. 17, 2018

(54) POLYCRYSTALLINE DIAMOND COMPACT INCLUDING CRACK-RESISTANT POLYCRYSTALLINE DIAMOND TABLE

(71) Applicant: US SYNTHETIC CORPORATION, Orem, UT (US)

(72) Inventor: David P. Miess, Highland, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

(21) Appl. No.: 14/515,768

(22) Filed: Oct. 16, 2014

Related U.S. Application Data

(60) Provisional application No. 61/891,525, filed on Oct. 16, 2013.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***B24D 99/00*** | (2010.01) |
| ***E21B 10/567*** | (2006.01) |

(52) U.S. Cl.
CPC ..... *B24D 3/00* (2013.01); *B24D 18/0009* (2013.01); *B24D 99/005* (2013.01); *E21B 10/567* (2013.01)

(58) Field of Classification Search
USPC ..... 51/309, 307, 293
See application file for complete search history.

(56) References Cited

U.S. PATENT DOCUMENTS

| | | | |
|---|---|---|---|
| 3,090,614 | A | 5/1963 | Freeman et al. |
| 3,655,233 | A | 4/1972 | Twist |
| 3,894,673 | A | 7/1975 | Lowder et al. |
| 4,268,276 | A | 5/1981 | Bovenkerk |
| 4,274,900 | A | 6/1981 | Mueller et al. |
| 4,410,054 | A | 10/1983 | Nagel et al. |
| 4,468,138 | A | 8/1984 | Nagel |

(Continued)

FOREIGN PATENT DOCUMENTS

WO WO 2016/044136 3/2016

OTHER PUBLICATIONS

U.S. Appl. No. 12/830,878, filed Jul. 6, 2010, Wiggins et al.

(Continued)

*Primary Examiner* — James E McDonough
(74) *Attorney, Agent, or Firm* — Dorsey & Whitney LLP

(57) ABSTRACT

Embodiments relate to polycrystalline diamond compacts ("PDCs") including a substrate and a polycrystalline diamond ("PCD") table mounted to the substrate. The PCD table includes an upper surface and one or more recesses extending inwardly from the upper surface of the PCD table. The one or more recesses may help prevent, stop, or limit crack propagation and may redistribute, breakup, or relieve stresses in the PCD table. In some embodiments, the one or more recesses exhibit, in plain view, a generally rectangular geometry, a generally circular geometry, or a generally triangular geometry. In some embodiments, the PCD table includes one or more channels that extend from a vertex of the one or more recesses. In some embodiments, the one or more channels and the one or more recesses may be at least partially filled with a sacrificial material. Methods for forming such PDCs are also discussed.

28 Claims, 7 Drawing Sheets

(56) References Cited

U.S. PATENT DOCUMENTS

| | | | |
|---|---|---|---|
| 4,560,014 | A | 12/1985 | Geczy |
| 4,592,682 | A | 6/1986 | Vanistendael |
| 4,629,373 | A | 12/1986 | Hall |
| 4,738,322 | A | 4/1988 | Hall et al. |
| 4,811,801 | A | 5/1989 | Salesky et al. |
| 4,893,859 | A | 1/1990 | Nash |
| 4,913,247 | A | 4/1990 | Jones |
| 5,011,515 | A | 4/1991 | Frushour |
| 5,016,718 | A | 5/1991 | Tandberg |
| 5,054,246 | A | 10/1991 | Phaal et al. |
| D324,056 | S | 2/1992 | Frazee |
| D324,226 | S | 2/1992 | Frazee |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,172,778 | A | 12/1992 | Tibbitts et al. |
| 5,364,192 | A | 11/1994 | Damm et al. |
| 5,368,398 | A | 11/1994 | Damm et al. |
| 5,460,233 | A | 10/1995 | Meany et al. |
| 5,480,233 | A | 1/1996 | Cunningham |
| 5,544,713 | A | 8/1996 | Dennis |
| 5,601,477 | A | 2/1997 | Bunting et al. |
| 5,662,720 | A | 9/1997 | O'Tighearnaigh |
| 5,669,271 | A | 9/1997 | Griffin et al. |
| 6,065,554 | A | 5/2000 | Taylor et al. |
| 6,110,030 | A | 8/2000 | Hashimoto |
| D436,820 | S | 1/2001 | Suzuki |
| 6,302,410 | B1 | 10/2001 | Wentworth et al. |
| 6,338,754 | B1 | 1/2002 | Cannon et al. |
| 6,793,681 | B1 | 9/2004 | Pope et al. |
| D554,162 | S | 10/2007 | Hall et al. |
| 7,464,973 | B1 | 12/2008 | Chapman et al. |
| D594,486 | S | 7/2009 | Morozov |
| 7,845,438 | B1 | 12/2010 | Vail et al. |
| 7,866,418 | B2 | 1/2011 | Bertagnolli et al. |
| 8,236,074 | B1 | 8/2012 | Bertagnolli et al. |
| 8,261,858 | B1 | 9/2012 | Atkins et al. |
| 8,297,382 | B2 | 10/2012 | Bertagnolli et al. |
| 8,596,387 | B1 | 12/2013 | Sani et al. |
| 8,734,552 | B1 | 5/2014 | Vail et al. |
| D708,238 | S | 7/2014 | Matti |
| 8,807,247 | B2 | 8/2014 | Scott et al. |
| 8,950,519 | B2 | 2/2015 | Gonzalez et al. |
| 9,062,505 | B2 | 6/2015 | Chapman et al. |
| 9,175,521 | B2 | 11/2015 | Bellin |
| 9,260,923 | B1 | 2/2016 | Bertagnolli et al. |
| 9,610,555 | B2 | 4/2017 | Mukhopadhyay et al. |
| 9,623,542 | B1 | 4/2017 | Miess et al. |
| 9,714,545 | B2 | 7/2017 | DiGiovanni et al. |
| 9,732,563 | B1 | 8/2017 | Mukhopadhyay |
| 9,650,839 | B1 | 9/2017 | Miess |
| 9,759,015 | B2 | 9/2017 | Miess |
| 9,844,854 | B1 | 12/2017 | Gleason et al. |
| 2009/0260877 | A1 | 10/2009 | Wirth |
| 2010/0326740 | A1 | 12/2010 | Hall et al. |
| 2011/0031036 | A1 | 2/2011 | Patel |
| 2011/0147083 | A1 | 6/2011 | Mauldin et al. |
| 2011/0171414 | A1* | 7/2011 | Sreshta ..... B22F 7/06 428/64.1 |
| 2012/0292188 | A1* | 11/2012 | Kim ..... B03C 5/022 204/547 |
| 2012/0325563 | A1 | 12/2012 | Scott et al. |
| 2013/0068534 | A1* | 3/2013 | DiGiovanni ..... E21B 10/5673 175/428 |
| 2013/0068537 | A1* | 3/2013 | DiGiovanni ..... E21B 10/55 175/430 |
| 2013/0263522 | A1* | 10/2013 | Nilen ..... B22F 7/06 51/307 |
| 2013/0292188 | A1 | 11/2013 | Bilen et al. |
| 2014/0318873 | A1 | 10/2014 | Patel et al. |
| 2014/0367177 | A1* | 12/2014 | Gonzalez ..... E21B 10/5673 175/430 |
| 2015/0292272 | A1 | 10/2015 | Can et al. |
| 2015/0298292 | A1 | 10/2015 | Can et al. |
| 2018/0010396 | A1 | 1/2018 | Dunbar et al. |

OTHER PUBLICATIONS

U.S. Appl. No. 12/961,787, filed Dec. 7, 2010, Mukhopadhyay et al.
U.S. Appl. No. 13/324,237, filed Dec. 13, 2011, Kidd et al.
U.S. Appl. No. 13/486,578, filed Jun. 1, 2012, Bertagnolli et al.
U.S. Appl. No. 61/891,525, filed Oct. 16, 2013, Miess.
U.S. Appl. No. 13/734,354, filed Jan. 4, 2013, Linford et al.
U.S. Appl. No. 13/790,046, filed Mar. 8, 2013, Cox.
U.S. Appl. No. 61/948,970, filed Mar. 6, 2014, Knuteson et al.
U.S. Appl. No. 14/273,360, filed May 8, 2014, Burton et al.
U.S. Appl. No. 14/275,574, filed May 12, 2014, Burton et al.
U.S. Appl. No. 62/002,001, filed May 22, 2014, Knuteson et al.
U.S. Appl. No. 14/627,966, filed Feb. 20, 2015, Linford et al.
U.S. Appl. No. 14/811,699, filed Jul. 28, 2015, Myers et al.
U.S. Appl. No. 62/232,732, filed Sep. 25, 2015, Weaver et al.
U.S. Appl. No. 62/279,271, filed Jan. 15, 2016, Mortensen et al.
U.S. Appl. No. 29/559,713, filed Mar. 30, 2016, Mortensen et al.
U.S. Appl. No. 29/559,713, dated Jan. 29, 2018, Restriction Requirement.

* cited by examiner

POLYCRYSTALLINE DIAMOND COMPACT INCLUDING CRACK-RESISTANT POLYCRYSTALLINE DIAMOND TABLE

CROSS-REFERENCE TO RELATED APPLICATIONS

This application claims priority to U.S. Provisional Application No. 61/891,525 filed on 16 Oct. 2013, the disclosure of which is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a diamond table. The diamond table may be formed and bonded to a substrate using a high-pressure, high-temperature ("HPHT") process. The PDC cutting element may also be brazed directly into a preformed pocket, socket, or other receptacle formed in the bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned adjacent to the cemented carbide substrate. A number of such cartridges may be loaded into an HPHT press. The substrates and volume of diamond particles are then processed under HPHT conditions in the presence of a catalyst that causes the diamond particles to bond to one another to form a matrix of bonded diamond grains defining a polycrystalline diamond ("PCD") table that is bonded to the substrate. The catalyst is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of bonded diamond grains.

Despite the availability of a number of different PCD materials, manufacturers and users of PCD materials continue to seek PCD materials that exhibit improved mechanical and/or thermal properties.

SUMMARY

Embodiments of the invention relate to PDCs including a PCD table having one or more recesses formed therein that help reduce crack formation therein and/or reduce crack propagation during cutting operations. In an embodiment, a PDC includes a substrate and a PCD table bonded to the substrate. The PCD table includes an upper surface including one or more recesses extending inwardly therefrom to a selected depth. The one or more recess are sized and configured to reduce cracking and/or crack propagation in the PCD table during use.

In some embodiments, the PCD table includes one or more channels that may extend from the one or more recesses. In some embodiments, the one or more channels may extend from a vertex of the one or more recesses. In some embodiments, the one or more channels and the one or more recesses may be at least partially filled with a sacrificial material. In some embodiments, the one or more recesses exhibit, in plain view, a generally rectangular geometry, a generally circular geometry, or a generally triangular geometry.

In an embodiment, a method of forming a PDC is disclosed. One or more sacrificial materials are positioned at least proximate to a substrate. A plurality of diamond particles are positioned adjacent to a portion of the one or more sacrificial materials to form an assembly. The assembly is subjected to an HPHT process effective to form a PCD table and bond the PCD table to the substrate. The sacrificial material defines one or more recess in the PCD table that are sized and configured to reduce cracking and/or crack propagation in the PCD table during use.

In an embodiment, a method of forming a PDC is disclosed. A plurality of diamond particles is positioned adjacent to an interfacial surface of a substrate to form an assembly. The assembly is subjected to an HPHT process effective to form a PCD table and bond the PCD table to the substrate. One or more recesses are formed in an upper surface of the PCD table that extend inwardly therefrom to a selected depth. The one or more recess in the PCD table are sized and configured to reduce cracking and/or crack propagation in the PCD table during use.

Further embodiments relate to applications utilizing the disclosed PCD elements and PDCs in various articles and apparatuses, such as rotary drill bits, bearing apparatuses, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

FIGS. 11-14A are cross-sectional views of different embodiments of PDCs having a selected PCD table configuration.

DETAILED DESCRIPTION

Figure 1A:
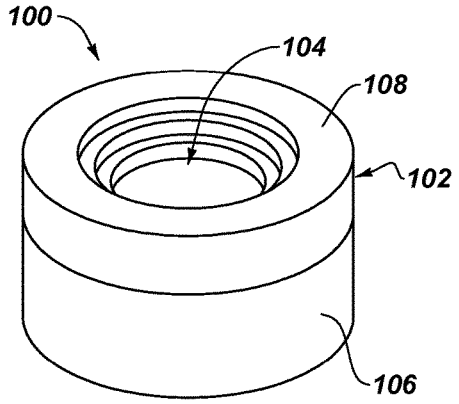
FIG. 1A is an isometric view of an embodiment of a PDC having a PCD table with at least one recess formed therein.

Embodiments of the invention relate to PDCs including a PCD table having one or more recesses formed therein that help reduce crack formation therein and/or reduce crack propagation during cutting operations. Forming one or more recesses in at least one surface of the PCD table may improve the life of the PDC by reducing cracks from forming therein and/or reducing cracks from propagating in the PCD table during cutting operations. Embodiments also relate to methods of fabricating such PDCs, and applications for such PDCs in rotary drill bits, bearing apparatuses, machining equipment, and other articles and apparatuses.

As will be discussed in more detail below, according to various embodiments, a PCD table may include one or more recesses formed therein. The one or more recesses may be configured as one or more of a hole, a slot, a channel, a dent, a gap, a pit, a pocket, a space, a void, an aperture, or a groove formed in an exterior surface of the PCD table that may help prevent, stop, or limit crack formation and propagation therein and may redistribute, breakup, or relieve stresses in the PCD table. In some embodiments, the one or more recesses and/or channels disclosed herein may form a substantially portion of the PCD table. For example, the one or more recesses and/or channels disclosed herein may comprise about 30% to about 80%, about 30% to about 45%, about 35% to about 45%, about 50% to about 65%, about 50% to about 80%, about 60% to about 70%, or about 60% to about 80% by volume of the PCD table.

The one or more recesses and/or channels may extend to an intermediate depth "d" within the PCD table or completely through the PCD table. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table, about less than half of the thickness of the PCD table, or about more than half of the thickness of the PCD table.

The one or more recesses may be formed in the PCD table during the HPHT process or after forming the PCD table. In some embodiments, one or more sacrificial materials may be present in at least a portion of the one or more recesses, such as a refractory metal material, a ceramic, or combinations thereof. The one or more sacrificial materials may be removed from the one or more recesses. In some embodiments, the one or more recesses may be formed without using a sacrificial material.

The one or more recesses may exhibit a number of geometries. In some embodiments, the one or more recesses may exhibit vertices or vertexes that induce limited crack formation in preferred regions of the PCD table. Other geometries may be used to orient the PCD table on a drill bit, or may exhibit different cutting regions between vertices. Additionally, in some embodiments, one or more channels may be formed in the PCD table along with the one or more recesses. Such a configuration may help stop cracks during cutting operations. For example, the one or more recesses may beneficially distribute stresses within the PCD table and along an upper surface of the PCD table. The one or more recesses may also prevent thumbnail crack propagation at the boundary of the one or more recesses.

Figure 1B:
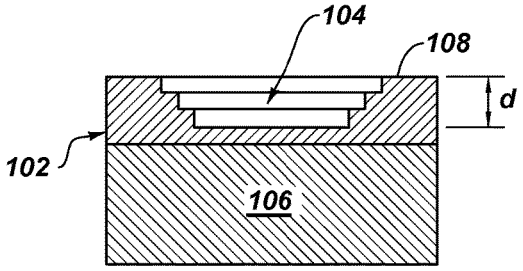
FIG. 1B is a cross-sectional view of the PDC shown in FIG. 1A.

FIGS. 1A and 1B are isometric and cross-sectional views, respectively, of an embodiment of a PDC 100 including a PCD table 102 having at least one recess 104 formed therein according to an embodiment. In the illustrated embodiment, the PCD table 102 may be bonded to a substrate 106. The recess 104 formed in the PCD table 102 may exhibit a generally circular geometry in plan view. The recess 104 may be centrally located or located off center on the PCD table 102. The recess 104 may extend from an upper surface 108 of the PCD table 102 to an intermediate depth "d" such that a portion of the PCD table 102 occupies a space between the recess 104 and the substrate 106. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 102, about less than half of the thickness of the PCD table 102, or about more than half of the thickness of the PCD table 102. Providing a portion of the PCD table 102 between the recess 104 and the substrate 106 may allow the PCD table 102, including a portion of the region of the PCD table between the recess 104 and the substrate 106, to be leached to a selected depth without affecting the substrate 106 (see FIG. 1D). That is, the base of the recess 104 may be leached without leaching an interface of the substrate 106. Alternatively, the recess 104 may extend completely through the PCD table 102 such that there is no portion of the PCD table 102 between the base of the recess 104 and the substrate 106.

In some embodiments, the recess 104 may form a substantially portion of the PCD table 102. For example, the recess 104 may comprise about 30% to about 80%, about 30% to about 45%, about 35% to about 45%, about 50% to about 65%, or about 60% to about 70% of the volume of the PCD table 102.

In the illustrated embodiment, the recess 104 has a diameter or other lateral dimension that increases with increasing distance toward the upper surface 108. For example, the recess 104 exhibits a stepped geometry. However, the recess 104 may exhibit other geometries such as a generally uniform diameter, a generally tapered geometry, or a generally curved geometry.

The PCD table 102 includes a plurality diamond grains that are directly bonded to each other via diamond-to-diamond bonding (e.g., $sp^3$ bonding) to define a plurality of interstitial regions therebetween. In some embodiments, the diamond grains may exhibit an average grain size of about 50 μm or less, such as about 30 μm or less, about 20 μm or less, about 10 μm to about 18 μm or, about 15 μm to about 18 μm. In some embodiments, the average grain size of the diamond grains may be about 10 μm or less, such as about 2 μm to about 5 μm or submicron.

The substrate 106 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the substrate 106 comprises cobalt-cemented tungsten carbide.

The PDC 100 may be fabricated according to various embodiments. In an embodiment, the PDC 100 may be fabricated by positioning diamond particles adjacent to the substrate 106 in a pressure transmitting medium to form a cell assembly and subjecting the cell assembly to an HPHT process. For example, the pressure transmitting medium may include a refractory metal can, graphite structure, pyrophyllite, other pressure transmitting structures, or combinations thereof. Examples of suitable gasket materials and cell structures for use in manufacturing PCD are disclosed in U.S. Pat. Nos. 6,338,754 and 8,236,074, each of which is incorporated herein, in its entirety, by this reference. Another example of a suitable pressure transmitting material is pyrophyllite, which is commercially available from Wonderstone Ltd. of South Africa.

The diamond particles may exhibit a bimodal or greater diamond particle size distribution. For example, the diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 30 μm, 20 μm, 15 μm, 12 μm, 10 μm, 8 μm) and another portion exhibiting at least one relatively smaller size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In some embodiments, the diamond particles may comprise three or more different sizes (e.g., one relatively larger size and two or more relatively smaller sizes), without limitation. In an embodiment, the diamond particles (and the PCD table 102 so formed) may exhibit two distinct diamond layers. For example, a first layer (not shown) may be positioned adjacent to the substrate 106 and include relatively larger size diamond particles. A second layer (not shown) may then be positioned adjacent to the first layer and include a relatively smaller size diamond particles. It is noted that the as-sintered diamond particle size of the PCD table 102 may differ from the average particle size of the diamond particles prior to sintering due to a variety of different physical processes, such as grain growth, diamond particles fracturing, carbon provided from another carbon source (e.g., dissolved carbon in a catalyst), or combinations of the foregoing.

In an embodiment, the recess 104 may be formed after the formation of the PDC 100. For example, the recess 104 may be formed in the PCD table 102 so formed by removing material from the PCD table 102 using laser machining, electro-discharge machining ("EDM"), or combinations thereof. After formation of the recess 104, the substrate 106 and/or PCD table 102 of the PDC 100 may be subjected to centerless grinding around a periphery thereof, the PCD table 102 may be lapped to planarize the PCD table 102, the PCD table 102 may be polished, or combinations thereof.

Figure 1C:
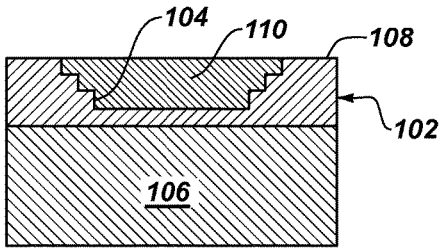
FIG. 1C is a cross-sectional view of the PDC shown in FIGS. 1A and 1B in which the at least one recess is filled with at least one sacrificial material according to an embodiment.

Referring to FIG. 1C, in another embodiment, the recess 104 may be formed in the PCD table 102 during the HPHT process. In an embodiment, a sacrificial material 110 is used to form the recess 104 during the HPHT process. For example, the diamond particles may be positioned around the sacrificial material 110 that defines the recess 104 and adjacent to the substrate 106 in a pressure transmitting medium to form a cell assembly. The sacrificial material 110 may include one or more refractory metal materials (e.g., niobium, molybdenum, tantalum, tungsten, combinations thereof, or alloys thereof), one or more ceramics (e.g., hexagonal boron nitride, silicon carbide, aluminum oxide, tungsten carbide or combinations thereof), or combinations of any of the foregoing sacrificial materials. In an embodiment, the sacrificial material 110 may be in the form of a plurality of stacked sacrificial material discs (e.g., niobium or molybdenum discs) that may be placed on or proximate to the substrate 106 in the cell assembly.

The sacrificial material 110 may remain in at least a portion of the recess 104 after the HPHT process. In some embodiments, the sacrificial material 110 may not be removed from the PDC 100 after HPHT processing the cell assembly. In such embodiments, the sacrificial material 110 may gradually wear away during use of the PDC 100. In other embodiments, the sacrificial material 110 may be removed after HPHT processing via leaching, abrasive blasting, laser machining, or combinations thereof. For example, the leaching process may be selective and only remove the sacrificial material 110 or, alternatively, may also remove a catalyst and/or metallic infiltrant from the PDC table 102.

The PDC 100 is formed by subjecting any of the cell assemblies discussed above, including the pressure transmitting medium, to an HPHT process at diamond-stable conditions using an ultra-high pressure press at a temperature of at least about 1000° C. (e.g., about 1100° C. to about 2200° C., or about 1200° C. to about 1450° C.) and a cell pressure in the pressure transmitting medium of at least about 5 GPa (e.g., about 7.5 GPa to about 15 GPa, at least about 7.5 GPa, at least about 8.0 GPa, at least about 9.0 GPa, at least about 10.0 GPa, at least about 11.0 GPa, at least about 12.0 GPa, or at least about 14 GPa) for a time sufficient to sinter the diamond particles together in the presence of a catalyst to form and bond the PCD table 102 to the substrate 106. For example, the catalyst may include a metal-solvent catalyst including iron, nickel, cobalt, or alloys thereof or a carbonate catalyst of Li, Na, K, Be, Mg, Ca, Sr, and Ba. The PCD table 102 so formed includes directly bonded-together diamond grains defining interstitial regions. At least a portion of the interstitial regions of the PCD table 102 may be at least partially occupied by the catalyst.

The pressure values employed in the HPHT processes disclosed herein refer to the cell pressure in the pressure transmitting medium at room temperature (e.g., about 25° Celsius) with application of pressure using an ultra-high pressure press and not the pressure applied to exterior of the cell assembly. The actual pressure in the pressure transmitting medium at sintering temperature may be slightly higher.

The catalyst material may be provided from a number of different sources. In an embodiment, the substrate 106 includes a metal-solvent catalyst. The metal-solvent catalyst from the substrate 106 may liquefy and infiltrate into the diamond particles during the HPHT process to promote growth between adjacent diamond particles to form the PCD table 102 comprised of a body of directly bonded-together diamond grains having the infiltrated metal-solvent catalyst interstitially disposed between bonded diamond grains. For example, if the substrate 106 is a cobalt-cemented tungsten carbide substrate, cobalt from the substrate 106 may be liquefied and infiltrate the diamond particles to catalyze formation of the PCD table 102 during the HPHT process. Alternatively or additionally, the catalyst may be provided in particulate form mixed with the diamond particles, as a thin foil or plate placed adjacent to the mass of diamond particles, from the sacrificial material 110, or combinations of the foregoing.

The catalyst that occupies the interstitial regions of the PCD table 102 between the bonded diamond grains may be present in the PCD table 102 in an amount of about 7.5 weight % or less. In some embodiments, the catalyst may be present in the PCD table 102, excluding the sacrificial material, in an amount of about 1 weight % to about 7.5 weight %, such as about 3 weight % to about 7.5 weight %, about 3 weight % to about 6 weight %, about 1 weight % to about 6 weight %, about 1 weight % to about 3 weight %, less than about 3 weight %, a residual amount to about 1 weight %, or greater than 0 weight % to about 1 weight %. By maintaining the amount of catalyst below about 7.5 weight %, the PCD table 102 may exhibit a desirable level of thermal stability suitable for subterranean drilling applications.

Generally, as the sintering cell pressure that is used to form the PDC 100 increases beyond about 7.5 GPa cell pressure, a coercivity of the PCD table 102 defined collectively by the diamond grains and the metal-solvent catalyst may increase, while the magnetic saturation and electrical conductivity may decrease. The PCD table 102 defined collectively by the bonded diamond grains and the metal-solvent catalyst may exhibit one or more of the following properties: a coercivity of about 115 Oe or more, a metal-solvent catalyst content of less than about 7.5 weight % as indicated by a specific magnetic saturation of about 15 $G{\cdot}cm^3/g$ or less, or an electrical conductivity less than about 1200 S/m. For example, the electrical conductivity may be an average electrical conductivity of the PCD table 102 or a region of the PCD table 102. In a more detailed embodiment, the coercivity of the PCD table 102 may be about 115 Oe to about 250 Oe, the specific magnetic saturation of the PCD table 102 may be greater than 0 $G{\cdot}cm^3/g$ to about 15 $G{\cdot}cm^3/g$, and the electrical conductivity may be about 25 S/m to about 1000 S/m. In an even more detailed embodiment, the coercivity of the PCD table 102 may be about 115 Oe to about 175 Oe, the specific magnetic saturation of the PCD table 102 may be about 5 $G{\cdot}cm^3/g$ to about 15 $G{\cdot}cm^3/g$, and the electrical conductivity may be less than about 750 S/m. In another more detailed embodiment, the coercivity of the PCD table 102 may be about 155 Oe to about 175 Oe, the specific magnetic saturation of the PCD table 102 may be about 10 $G{\cdot}cm^3/g$ to about 15 $G{\cdot}cm^3/g$, and the electrical conductivity may be less than about 500 S/m. In yet another embodiment the coercivity of the PCD table may be 155 Oe to about 175 Oe, the specific magnetic saturation of the PCD table 102 may be about 10 $G{\cdot}cm^3/g$ to about 15 $G{\cdot}cm^3/g$, and the electrical conductivity may be about 1050 S/m to about 500 S/m. In another embodiment, the coercivity of the PCD table 102 may be about 130 Oe to about 160 Oe, the specific magnetic saturation of the PCD table 102 may be about 5 $G{\cdot}cm^3/g$ to about 15 $G{\cdot}cm^3/g$, and the electrical conductivity may be about 50 S/m to about 150 S/m. The specific permeability (i.e., a ratio of specific magnetic saturation to coercivity) of the PCD table 102 may be about 0.10 or less, such as about 0.060 to about 0.090. In some embodiments, despite the average grain size of the bonded diamond grains being less than about 30 μm, the metal-solvent catalyst content in the PCD table 102 may be less than about 7.5 weight % resulting in a desirable thermal stability.

More details about magnetic and electrical properties of the PCD table 102, techniques for measuring such magnetic and electrical properties, and methods of fabricating the PCD table 102 are disclosed in U.S. Pat. No. 7,866,418; U.S. application Ser. No. 13/486,578; and U.S. application Ser. No. 12/830,878. U.S. Pat. No. 7,866,418; U.S. application Ser. No. 13/486,578; and U.S. application Ser. No. 12/830,878 are each incorporated herein, in their entirety, by this reference.

Figure 1D:
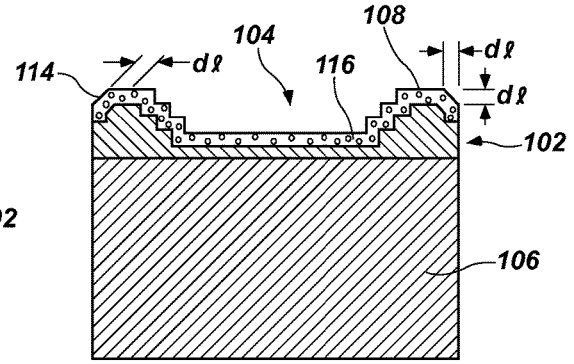
FIG. 1D is a cross-sectional view of the PDC shown in FIGS. 1A and 1B in which a PCD table thereof has been leached.

In an embodiment illustrated in FIG. 1D, after the HPHT process, the catalyst may be leached from the PCD table 102 to a selected depth "$d_1$" using an acid leaching process or a gaseous leaching process to form a leached region 116. For example, the catalyst may be at least partially leached from the PCD table 102 to the selected depth "$d_1$" as measured from at least one of the upper surface 108, at least one lateral surface 112, or a chamfer 114 extending between the upper surface 108 and the at least one lateral surface 112 to form a leached region 116 that is depleted of the catalyst. For example, the selected depth "$d_1$" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 102, about less than half of the thickness of the PCD table 102, or about more than half of the thickness of the PCD table 102. It should be noted that although leaching is described in context of leaching the PCD table 102 shown in FIGS. 1A and 1B, any of the PCD tables disclosed herein may be leached to the same depths $d_1$ from at least one of an upper surface, at least one lateral surface, or chamfer thereof and using the same techniques as described herein for the PCD table 102.

In some embodiments, the leached region 116 may be formed by acid leaching of the PCD table 102 in a suitable acid, such as hydrochloric acid, nitric acid, hydrofluoric acid, aqua regia, or combinations thereof. In other embodiments, the leached region 116 of the PCD table 102 may be formed by exposing the PCD table 102 to a gaseous leaching agent that is selected to substantially remove all of the catalyst from the interstitial regions of the PCD table 102. A gaseous leaching agent may be selected from at least one halide gas, at least one inert gas, a gas from the decomposition of an ammonium halide salt, hydrogen gas, carbon monoxide gas, an acid gas, and mixtures thereof. For example, a gaseous leaching agent may include mixtures of a halogen gas (e.g., chlorine, fluorine, bromine, iodine, or combinations thereof) and an inert gas (e.g., argon, xenon, neon, krypton, radon, or combinations thereof). Other gaseous leaching agents include mixtures including hydrogen chloride gas, a reducing gas (e.g., carbon monoxide gas), gas from the decomposition of an ammonium salt (such as ammonium chloride which decomposes into chlorine gas, hydrogen gas and nitrogen gas), and mixtures of hydrogen gas and chlorine gas (which will form hydrogen chloride gas, in situ), acid gases such as hydrogen chloride gas, hydrochloric acid gas, hydrogen fluoride gas, and hydrofluoric acid gas. Any combination of any of the disclosed gases may be employed as the gaseous leaching agent.

Additional details about gaseous leaching processes for leaching PCD elements are disclosed in U.S. application Ser. No. 13/324,237 and U.S. application Ser. No. 12/961,787. U.S. application Ser. No. 13/324,237 and U.S. application Ser. No. 12/961,787 are incorporated herein, in their entirety, by this reference.

In some embodiments, at least some of the leaching by-products generated by the leaching process may be removed from the PCD table 102 that has been leached. At least some of the leaching by-products may be removed by subjecting the PCD table 102 that has been leached to a thermal-cleaning process, a chemical cleaning process or an ultrasonic cleaning process. For example, the PDC 100 including the PCD table 102 that has been leached may placed in a vacuum furnace, an autoclave, or a reaction vessel containing an acid. Additional details about techniques for cleaning the PCD table 102 that has been leached are disclosed in U.S. Pat. No. 7,845,438. U.S. Pat. No. 7,845,438 is incorporated herein, in its entirety, by this reference.

In some embodiments, the interstitial regions of the leached region 116 of the PDC 100 shown in FIG. 1D may be infiltrated with a replacement material in an HPHT process that is separate or concurrent with infiltrating the metal-solvent catalyst or infiltrant, or a separate non-HPHT process. Incorporating a replacement material into the leached region may increase abrasion resistance without substantially compromising thermal stability.

According to various embodiments, the replacement material may comprise a nonmetallic diamond catalyst selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a geranium alloy), and combinations of the foregoing. Suitable alkali metal carbonate materials are disclosed in U.S. Pat. No. 8,734,552, which is incorporated herein, in its entirety, by this reference.

In another embodiment, the replacement material may comprise a material that is relatively noncatalytic with respect to diamond, such as portions of the sacrificial material, silicon or a silicon-cobalt alloy. The silicon or a silicon-cobalt alloy may at least partially react with the diamond grains of the leached region so that it comprises silicon carbide, cobalt carbide, a mixed carbide of cobalt and silicon, or combinations of the foregoing and may also include silicon and/or a silicon-cobalt alloy (e.g., cobalt silicide). For example, silicon carbide, cobalt carbide, and a mixed carbide of cobalt and silicon are reaction products that may be formed by the replacement material reacting with the diamond grains of the leached second region.

In other embodiments, the PCD table 102 may be formed in a first HPHT process as described above. For example, the PCD table 102 may be separated from the substrate 104 using, for example, EDM, grinding, or lapping, or combinations thereof. The preformed PCD table 102 may be leached to remove substantially all of the catalyst therefrom. The preformed PCD table 102 may subsequently be bonded to another substrate 104 in a second HPHT process using any of the HPHT process conditions disclosed herein to bond the PCD table 102 to another substrate 106. In the second HPHT process, an infiltrant from, for example, the substrate 102 may infiltrate into the interstitial regions of the at least partially leached PCD table 102 to form an infiltrated PCD table 102 that is bonded to the substrate 106. For example, the infiltrant may be cobalt that is provided and swept-in from a cobalt-cemented tungsten carbide substrate. In an embodiment, infiltration may proceed all of the way to an upper surface of the infiltrated PCD table 102. In an embodiment, the infiltrant may be leached from the infiltrated PCD table 102 using a second leaching process following the second HPHT process to any of the selected depths "$d_1$" disclosed herein.

Figure 2A:
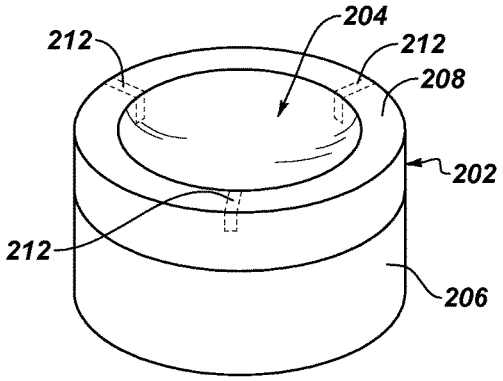
FIG. 2A is an isometric view of an embodiment of a PDC having a PCD table with at least one recess formed therein.
Figure 2B:
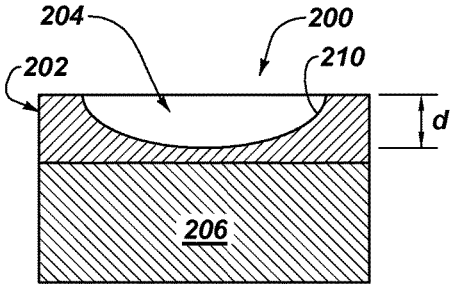
FIG. 2B is a cross-sectional view of the PDC shown in FIG. 2A.

The one or more recesses may exhibit other geometries according to other embodiments. For example, FIGS. 2A and 2B are isometric and cross-sectional views, respectively, of an embodiment of a PDC 200 including a PCD table 202 having at least one recess 204 formed therein according to an embodiment. The PDC 200 may be formed in a similar manner and from the same materials as PDC 100 shown in FIG. 1, and in the interest of brevity mainly the differences between the PDC 100 and the PDC 200 are discussed below.

The recess 204 may exhibit a generally partial elliptical geometry in cross-section and a generally circular geometry in plan view, with a concave surface 210 of the PCD table 202 defining the recess 204. The concave surface 210 may define part of a generally elliptical surface, such as part of a generally spherical surface or other concave surface. The recess 204 may be generally centrally located or located off center on the PCD table 202.

In an embodiment, the recess 204 extends from an upper surface 208 of the PCD table 202 to an intermediate depth "d" such that a portion of the PCD table 202 occupies the space between a base of the recess 204 and the substrate 206. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 202, about less than half of the thickness of the PCD table 202, or about more than half of the thickness of the PCD table 202. In another embodiment, the recess 204 may extend completely through the PCD table 202. In some embodiments, a plurality of channels 212 may be interconnected with and extend radially from the recess 204. For example, the plurality of channels 212 may be circumferentially spaced from each other. In the illustrated embodiment, only three channels 212 are shown, but more or less than three channels may be provided. Each of the channels 212 may be extend to a depth in the PCD table 202 from the upper surface 208 thereof that is the same, less than, or greater than the depth to which the recess 204 extends.

As discussed above in relation to the PDC 100, in some embodiments, the recess 204 and optional channels 212 may be filled with any of the sacrificial materials disclosed herein. In some embodiments, the sacrificial material may not be removed from the PDC 200 after the HPHT process. In such embodiments, the sacrificial material may gradually wear away during use. In other embodiments, the sacrificial material may be removed via leaching, abrasive blasting, laser machining, or combinations of the foregoing material removal processes. For example, the leaching process may be selective and only remove the sacrificial material or, alternatively, may also remove catalyst and/or metallic infiltrant in the PDC table 202.

Figure 3A:
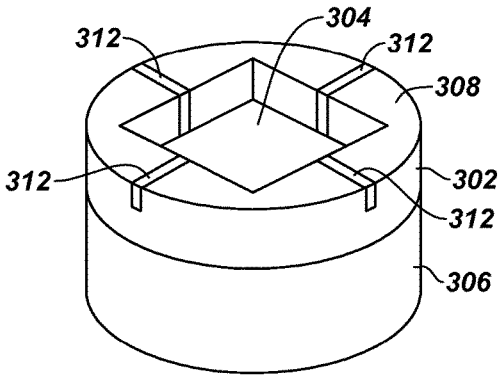
FIG. 3A is an isometric view of an embodiment of a PDC having a PCD table with at least one recess formed therein having a generally rectangular geometry.
Figure 3B:
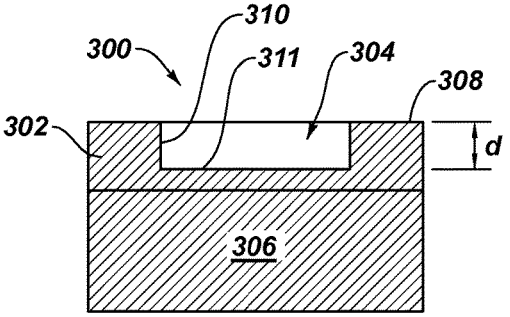
FIG. 3B is a cross-sectional view of the PDC shown in FIG. 3A.

FIGS. 3A and 3B are isometric and cross-sectional views, respectively, of an embodiment of a PDC 300 including a PCD table 302 having at least one recess 304. The PDC 300 may be formed in a similar manner and from the same materials as PDC 100 shown in FIG. 1, and in the interest of brevity mainly the differences between the PDC 100 and the PDC 300 are discussed below.

The recess 304 exhibits a generally rectangular geometry in plan and cross-sectional view. The recess 304 may be centrally located or located off center on the PCD table 302. The recess 304 may extend from an upper surface 308 of the PCD table 302 to an intermediate depth "d" such that a portion of the PCD table 304 occupies the space between the base of the recess 304 and the substrate 306. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 302, about less than half of the thickness of the PCD table 302, or about more than half of the thickness of the PCD table 302. In another embodiment, the recess 304 may extend completely through the PCD table 302. The recess 304 may be defined by sidewalls 310 that may be generally vertical and a base 311 that may be generally horizontal and substantially perpendicular to the sidewalls 310. In the illustrated embodiment, corners of the recess 304 may terminate at a location inwardly from an outer periphery or diameter of the PDC 300 and the PCD table 302, while in other embodiments, the corners of the recess 304 may be located at or near the outer periphery or diameter of the PCD table 302.

In some embodiments, a plurality of channels 312 may extend radially from the recess 304. For example, the plurality of channels 312 may be circumferentially spaced from each other. In the illustrated embodiment, each channel 312 extends from one of the sidewall surfaces 310, but each or some of the channels 312 may extend from a corresponding corner or vertex of the recess 304 in other embodiments. In the illustrated embodiment, only four channels 312 are shown, but more or less than four channels may be provided. Each of the channels 312 may be extend to a depth in the PCD table 302 from the upper surface 308 thereof that is the same, less than, or greater than the depth to which the recess 304 extends.

In some embodiments, the recess 304 and optional channels 312 may be filled with any of the sacrificial materials disclosed herein. In some embodiments, the sacrificial material may not be removed from the PDC 300 after the HPHT process. In other embodiments, the sacrificial material may be removed after the HPHT process via leaching, abrasive blasting, laser machining, or combinations thereof.

In use, the PDC 300 may be rotated four times so that the different respective regions of the PCD table 302 between adjacent vertices of the PCD table 302 serve as the cutting region of the drill bit to which it is mounted.

Figure 4A:
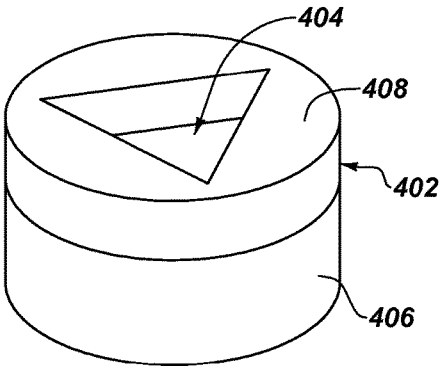
FIG. 4A is an isometric view of an embodiment of a PDC having a PCD table with at least one recess formed therein having a generally triangular geometry.
Figure 4B:
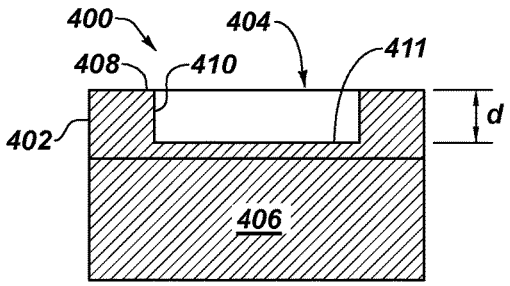
FIG. 4B is a cross-sectional view of the PDC shown in FIG. 4A.

FIGS. 4A and 4B are isometric and cross-sectional views, respectively, of an embodiment of a PDC 400 including a PCD table 402 having at least one recess 404 formed therein having a generally triangular geometry in plan view. The PDC 400 may be formed in a similar manner and from the same materials as PDC 100 shown in FIG. 1, and in the interest of brevity mainly the differences between the PDC 100 and the PDC 400 are discussed below.

The recess 404 may be centrally located or located off center on the PCD table 402. The recess 404 extends from an upper surface 408 of the PCD table 402 to an intermediate depth "d" such that a portion of the PCD table 402 occupies the space between the base of the recess 404 and the substrate 406. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 402, about less than half of the thickness of the PCD table 402, or about more than half of the thickness of the PCD table 402. In another embodiment, the recess 404 may extend completely through the PCD table 402.

The recess 404 may be defined by sidewalls 410 that may be generally vertical and a base 411 that may be generally horizontal and substantially perpendicular to the sidewalls 410. In the illustrated embodiment, corners of the recess 404 may terminate at a location inwardly from an outer periphery or diameter of the PDC 400 and the PCD table 402, while in other embodiments, the corners of the recess 404 may be located at or near the outer periphery or diameter of the PCD table 402. Although not shown, in some embodiments, a plurality of channels may be interconnected with and extended radially from the recess 404. For example, the plurality of channels may be circumferentially spaced from each other and may extend from a corresponding corner, vertex, or sidewall of the recess 404.

In some embodiments, the recess 404 and optional channels 412 may be filled with any of the sacrificial materials disclosed herein. In some embodiments, the sacrificial material may or may not be removed from the PDC 400 after the HPHT process.

In use, the PDC 400 may be rotated three times so that the different respective regions of the PCD table 402 between adjacent vertices of the PCD table 402 serve as the cutting region of the drill bit to which it is mounted.

Figure 5A:
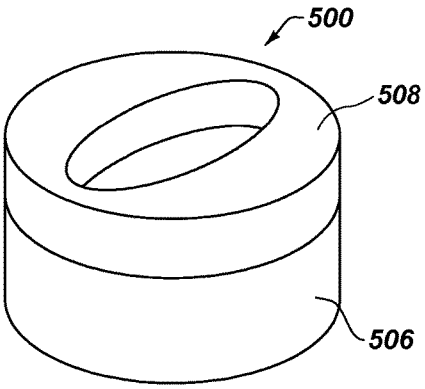
FIG. 5A is an isometric view of an embodiment of a PDC having a PCD table with at least one recess formed therein having a generally elliptical geometry.
Figure 5B:
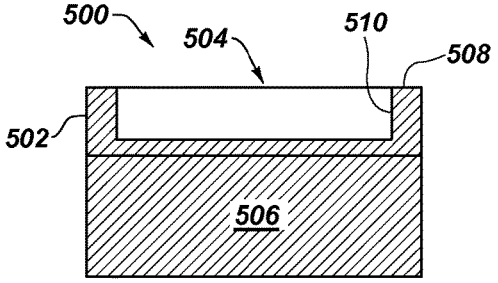
FIG. 5B is a cross-sectional view of the PDC shown in FIG. 5A.

FIGS. 5A and 5B are isometric and cross-sectional views, respectively, of an embodiment of a PDC 500 including a PCD table 502 having a generally elliptically shaped recess 504 in plan view according to an embodiment. The PDC 500 may be formed in a similar manner and from the same materials as PDC 100 shown in FIG. 1, and in the interest of brevity mainly the differences between the PDC 100 and the PDC 500 are discussed below.

The recess 504 may have tapered or substantially vertical sidewalls 510. For example, the recess 504 may be centrally located or located off center on the PCD table 502. The recess 504 extends from an upper surface 508 of the PCD table 502 to an intermediate depth "d" such that a portion of the PCD table 502 occupies the space between the base of the recess 504 and the substrate 506. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 402, about less than half of the thickness of the PCD table 502, or about more than half of the thickness of the PCD table 502. In another embodiment, the recess 504 may extend completely through the PCD table 502.

In an embodiment, one or more channels (not shown) may be provided that are interconnected with and extend from the recess 504 and/or the recess 504 and/or channels may be filled with any of the sacrificial materials disclosed herein. In use, the PDC 500 may be rotated two times so that the different respective regions of the PCD table 502 serve as the cutting region of the drill bit to which it is mounted.

Figure 6:
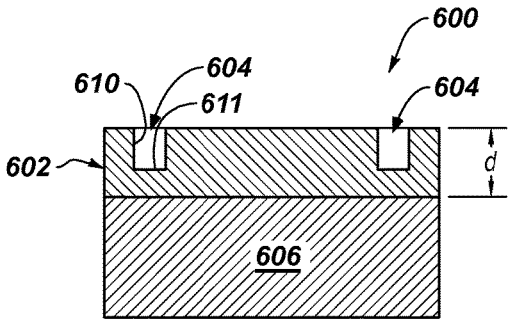
FIG. 6 is a cross-sectional view of an embodiment of a PDC including a PCD table having at least one annular recess.

In other embodiments, a recess of a PCD table may be formed in a peripheral region of the PCD table. For example, FIG. 6 is a cross-sectional view of an embodiment of a PDC 600 including a PCD table 602 having at least one annular recess 604 formed in the PCD table 602. The PDC 600 may be formed in a similar manner and from the same materials as PDC 100 shown in FIG. 1, and in the interest of brevity mainly the differences between the PDC 100 and the PDC 600 are discussed below.

The recess 604 extends from an upper surface 608 of the PCD table 602 to an intermediate depth "d." For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 602, about less than half of the thickness of the PCD table 602, or about more than half of the thickness of the PCD table 602. In another embodiment, the recess 604 may extend completely through the PCD table 602.

Figure 7:
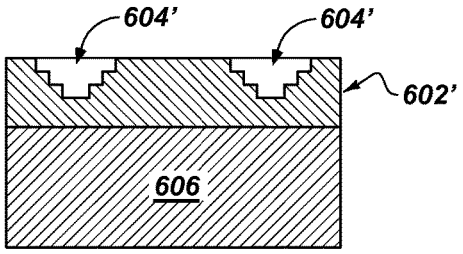
FIG. 7 is a cross-sectional view of another embodiment of a PDC including a PCD table having at least one annular recess.

The recess 604 exhibits a generally rectangular cross-sectional geometry with the recess 604 defined by sidewalls 610 and a base 611. FIG. 7 is a cross-sectional view of another embodiment in which the sidewalls of the recess 604' of the PCD table 602' have a stepped geometry. However, other sidewall geometries for the recess 604 may be employed, such as tapered or curved sidewalls.

In another embodiment, the PCD table 602 or 602' may have a plurality of annular recesses 604 that are radially spaced from each other. Although not shown, in some embodiments, a plurality of channels may be interconnected with and extend radially inwardly or outwardly from the recess(es) 604. For example, the plurality of channels may be circumferentially spaced from each other.

Figure 8:
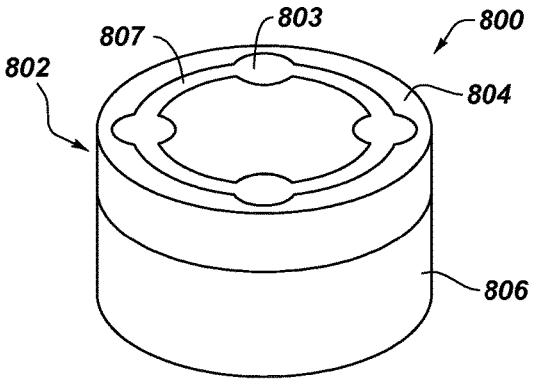
FIG. 8 is an isometric view of another embodiment of a PDC including a PCD table having at least one annular recess.

FIG. 8 is an isometric view of an embodiment of a PDC 800 including a PCD table 802 having at least one annular recess 804 formed therein. The PDC 800 may be formed in a similar manner and from the same materials as PDC 100 shown in FIG. 1, and in the interest of brevity mainly the differences between the PDC 100 and the PDC 800 are discussed below.

The annular recess 804 includes a plurality of circumferentially-spaced pockets 805 interconnected by annular portions 807 of the annular recess 804. The pockets 805 may facilitate alignment of a specific portion of the PCD table 802 of the PDC 800 during brazing and re-brazing of the PDC 800 to a drill bit body. Like the other embodiments, the annular recess 804 (including the annular portions 807 and the pockets 805) may extend only partially through the PCD table 802 to a selected intermediate depth "d" or may extend completely through the PCD table 802. For example, the intermediate depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about less than a third of the thickness of the PCD table 802, about less than half of the thickness of the PCD table 802, or about more than half of the thickness of the PCD table 802.

As discussed above in relation to the PDC 100, in some embodiments, the annular recess 804 and any optional channels may be filled with any of the sacrificial materials disclosed herein. In some embodiments, the sacrificial material may not be removed from the PDC 800 after the HPHT process. In other embodiments, the sacrificial material may be removed after the HPHT process via any of the disclosed material removal processes.

Figure 9:
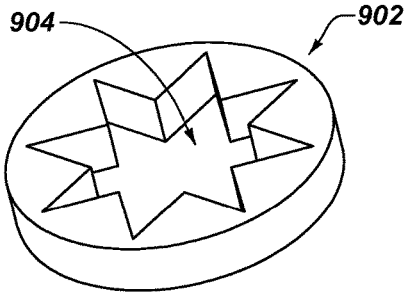
FIG. 9 is an isometric view of another embodiment of a PDC including a PCD table having a star-shaped recess.

FIG. 9 is an isometric view of an embodiment of a PDC 900 including a PCD table 902 bonded to a substrate (not shown) and having a star-shaped recess 904 formed therein. The PDC 900 may be formed in a similar manner and from the same materials as PDC 100 shown in FIG. 1, and in the interest of brevity mainly the differences between the PDC 100 and the PDC 900 are discussed below.

The star-shaped recess 904 may extend partially or completely through the PCD table 902. As discussed above, in some embodiments, the recess 904 and any optional channels interconnected with and extending radially outwardly from the recess 904 may be filled with any of the sacrificial materials disclosed herein. In other embodiments, the sacrificial material may be removed via any of the disclosed material removal processes. The vertices of the recess 904 may function to preferentially initiate crack propagation. It should be noted that additional recess geometries that include vertices may be used to preferentially initiate crack propagation in selected regions of the PCD table 902 other than the illustrated geometry for the recess 904.

In the illustrated embodiment shown in FIG. 9, the PCD table 904 is not shown to be presently bonded to a substrate. In an embodiment, the PCD table 904 may be formed in a first HPHT process similar to PDC 100 except that a substrate is not placed in the cell assembly with diamond particles and the optional sacrificial material. In another embodiment, the PCD table 904 may be formed in a first HPHT process similar to PDC 100 except that the PCD table 902 may be separated from the substrate after the first HPHT process. For example, the PCD table 902 may be separated from the substrate using, for example, EDM, grinding, lapping, or combinations thereof. In both embodiments, the preformed PCD table 902 may be leached to remove substantially all of the catalyst therefrom. The preformed PCD table 902 may subsequently be bonded to a substrate in a second HPHT process to form a PDC including the PCD table 902 bonded to a substrate. In the second HPHT process, an infiltrant from, for example, the substrate may infiltrate into the interstitial regions of the at least partially leached PCD table 902 to form an infiltrated PCD table 902 that is bonded to the substrate. For example, the infiltrant may be cobalt that is provided and swept-in from a cobalt-cemented tungsten carbide substrate. In an embodiment, infiltration may proceed all of the way to the second side surface of the infiltrated PCD table 902. In an embodiment, the infiltrant may be leached from the infiltrated PCD table 902 using a second leaching process following the second HPHT process.

Figure 10A:
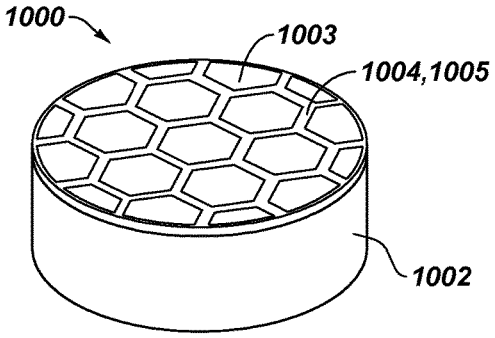
FIG. 10A is an isometric view of an embodiment of a PDC including a PCD table having hexagonal and other geometry protrusions separated by a network of recesses.

FIG. 10A is an isometric view of an embodiment of a PDC 1000 including a PCD table 1002 having hexagonal or other geometry protrusions 1003 separated by a network of recesses 1004. The PDC 1000 may be formed in a similar manner and from the same materials as PDC 100 shown in FIG. 1, and in the interest of brevity mainly the differences between the PDC 100 and the PDC 1000 are discussed below.

Figure 10B:
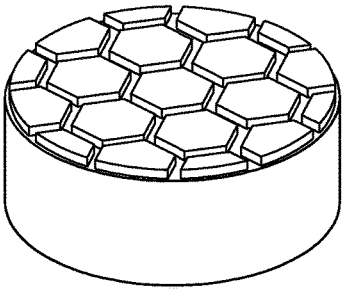
FIG. 10B is an isometric view of the PDC shown in FIG. 10A in which a sacrificial material has been removed from the network of recesses according to an embodiment.

The recesses 1004 may extend partially or completely through the PCD table 1002. In FIG. 10A, the recesses 1004 are at least partially filled with a sacrificial material 1005 so that the PCD table 1002 exhibits a substantially planar upper surface. In another embodiment shown in FIG. 10B, the sacrificial material 1005 may be removed after the HPHT process via any of the disclosed material removal processes.

Other embodiments for the PCD table configuration are also disclosed. FIGS. 11-14B illustrate different embodiments for PDCs having a selected PCD table configuration. The PDCs illustrated in FIGS. 11-14B may be formed in a similar manner and using the same materials as PDC 100 shown in FIG. 1, and in the interest of brevity mainly the differences between the PDC 100 and the PDCs shown in FIGS. 11-14B are discussed below.

Figure 11:
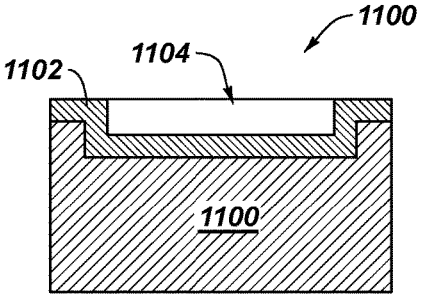
Figure 12:
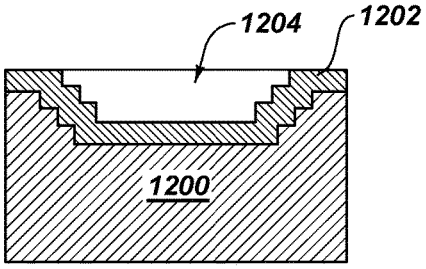

FIG. 11 illustrates a PDC 1100 having a substrate with a non-planar interfacial surface such as a slot, hole, or channel. The recess 1104 of the PCD table 1102 exhibits a shape that generally conforms to the non-planar interfacial surface of the substrate 1106 to which the PCD table 1102 is bonded. FIG. 12 is a variation of the PDC 1100 in which a recess 1204 of a PCD table 1202 and a substrate 1206 have a different, more elaborate stepped geometry according to another embodiment.

Figure 13:
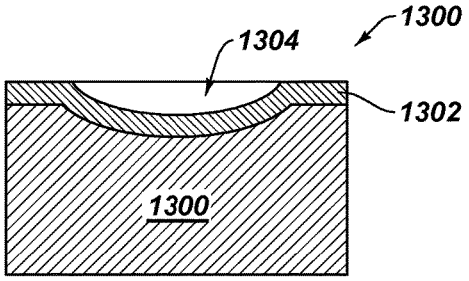

FIG. 13 illustrates a PDC 1300 having a substrate with a non-planar and partially curved interfacial surface. A recess 1304 of the PCD table 1302 exhibits a shape that generally conforms to the non-planar and partially curved interfacial surface of the substrate 1306 to which the PCD table 1302 is bonded.

Figure 14A:
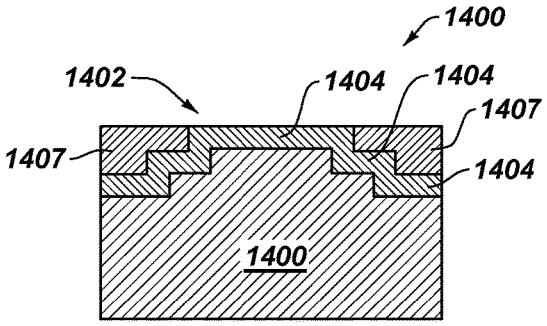
Figure 14B:
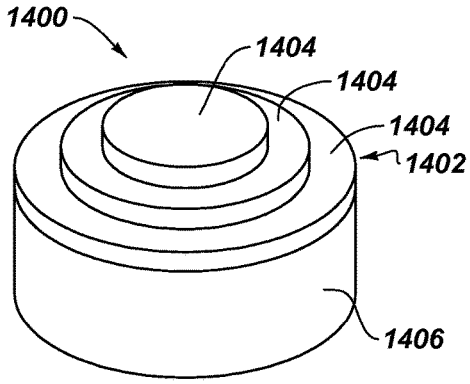
FIG. 14B is an isometric view of the PDC shown in FIG. 14A.

FIGS. 14A and 14B are cross-sectional and isometric views, respectively, of a PDC 1400 having a PCD table 1402 bonded to the substrate 1406 that includes a recess 1407 along the exterior periphery of the PCD table 1402 instead of an interior of the PCD table 1402. The recess 1407 of the PDC 1400 may be formed by using a plurality of annular discs of sacrificial material, with a diameter of the annular discs of sacrificial material increases as a distance from an upper surface of the PCD table 1402 increases. The PCD table 1402 so formed includes a plurality of PCD discs 1404 each of which has a decreasing diameter with increasing distance from the substrate 1406.

In any of the embodiments shown in FIGS. 11-14B, the recess or depressions in the PCD tables may be filled with any of the sacrificial materials disclosed herein. For example, the recesses 1104, 1204, 1304, and 1407 may be at least partially filled with any of the sacrificial materials disclosed herein. In other embodiments, the sacrificial material may be removed after the HPHT process via any of the disclosed material removal processes.

Figure 16:
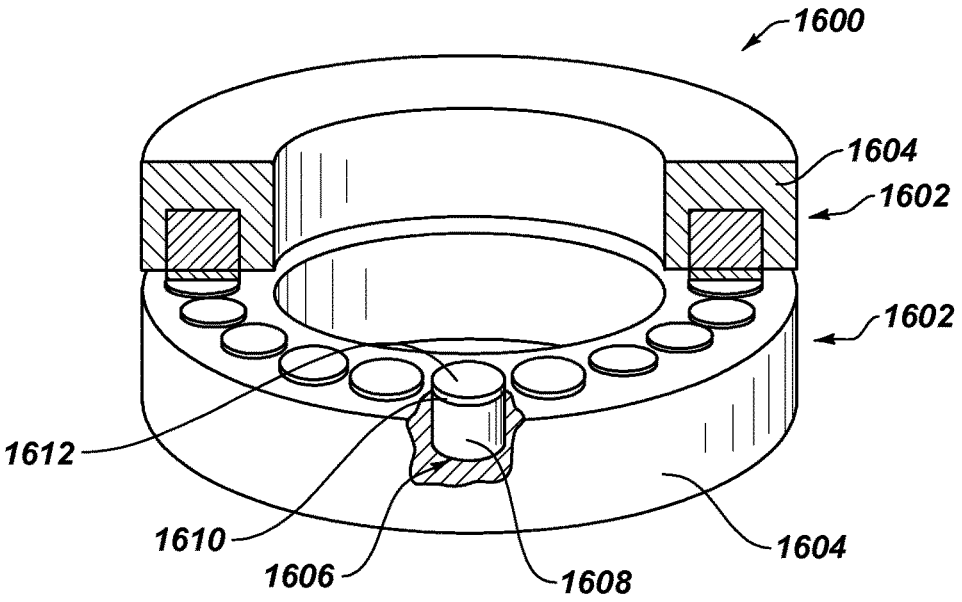
FIG. 16 is an isometric cutaway view of an embodiment of a thrust-bearing apparatus that may utilize one or more of the disclosed PDC embodiments.
Figure 17:
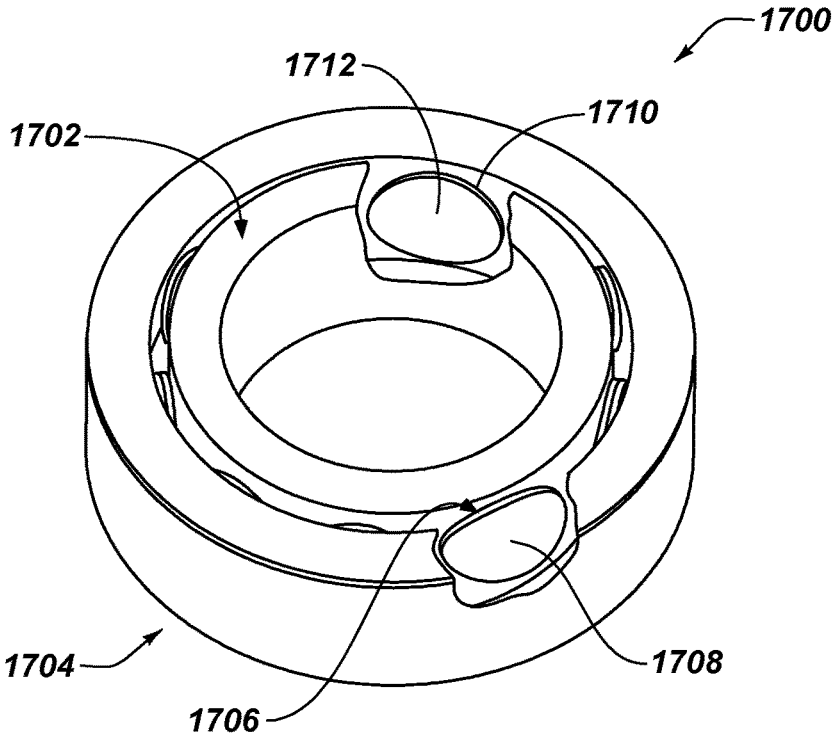
FIG. 17 is an isometric cutaway view of an embodiment of a radial bearing apparatus that may utilize one or more of the disclosed PDC embodiments.

The disclosed PCD elements and PDC embodiments may be used in a number of different applications including, but not limited to, use in a rotary drill bit (FIGS. 15A and 15B), a thrust-bearing apparatus (FIG. 16), and a radial bearing apparatus (FIG. 17). The various applications discussed above are merely some examples of applications in which the PDC embodiments may be used. Other applications are contemplated, such as employing the disclosed PDC embodiments in friction stir welding tools.

Figure 15A:
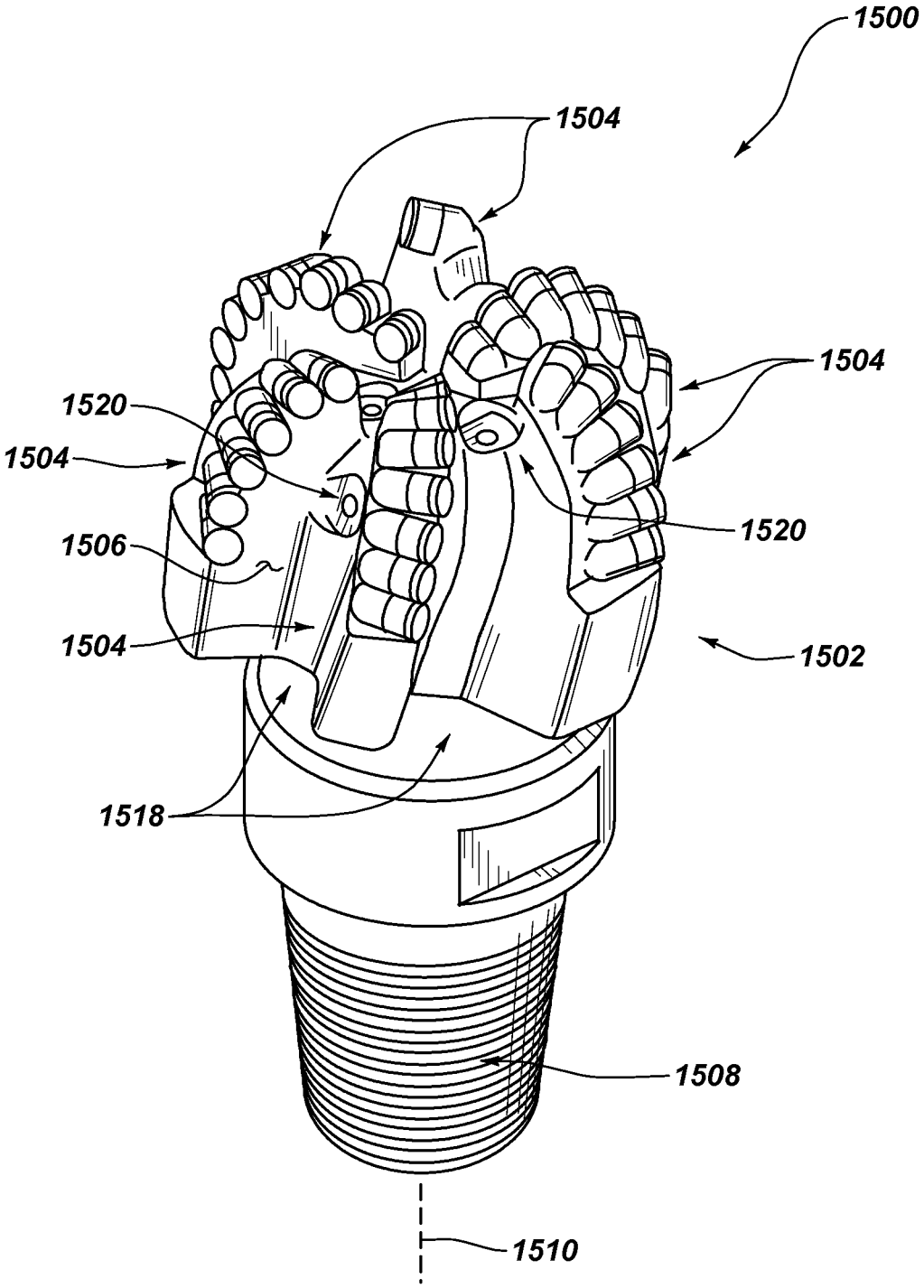
FIG. 15A is an isometric view of an embodiment of a rotary drill bit that may employ one or more of the disclosed PDC embodiments.
Figure 15B:
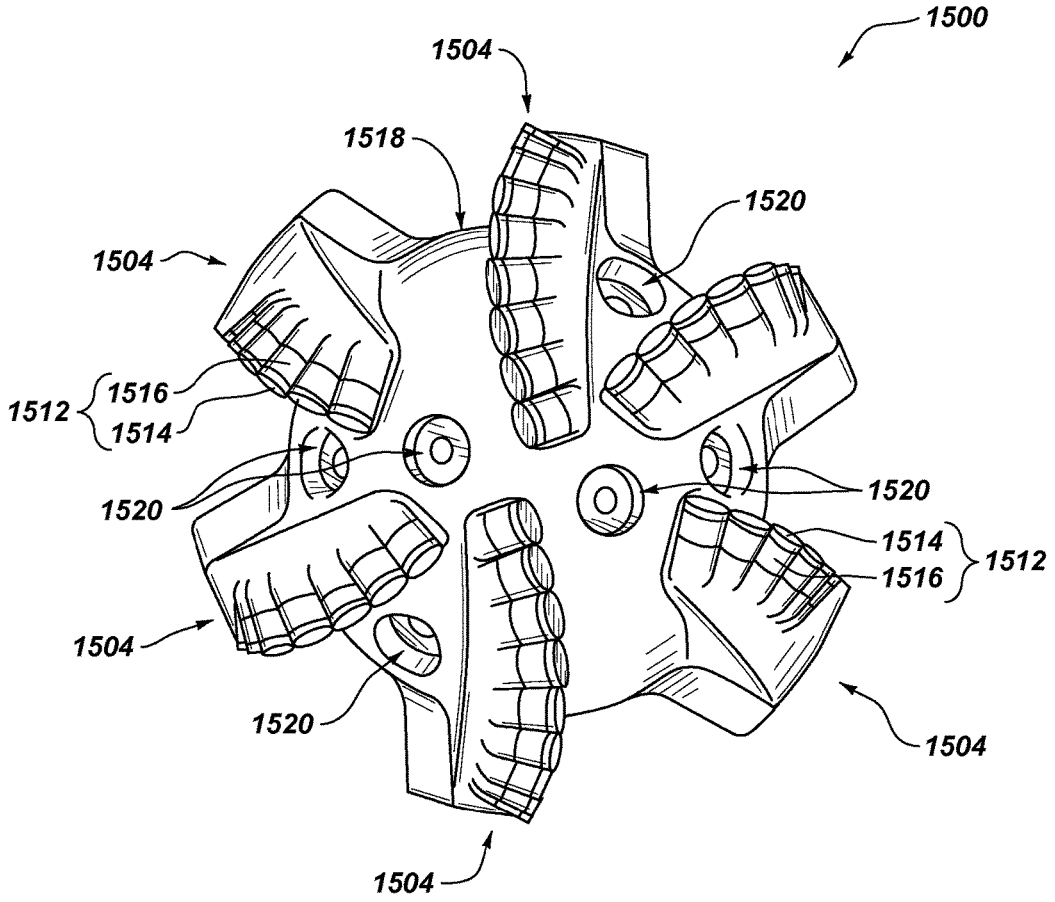
FIG. 15B is a top elevation view of the rotary drill bit shown in FIG. 15A.

FIG. 15A is an isometric view and FIG. 15B is a top elevation view of an embodiment of a rotary drill bit 1500 for use in subterranean drilling applications, such as oil and gas exploration. The rotary drill bit 1500 includes at least one PCD element and/or PDC configured according to any of the previously described PDC embodiments. The rotary drill bit 1500 comprises a bit body 1502 that includes radially and longitudinally extending blades 1504 with leading faces 1506, and a threaded pin connection 1508 for connecting the bit body 1502 to a drilling string. The bit body 1502 defines a leading end structure for drilling into a subterranean formation by rotation about a longitudinal axis 1510 and application of weight-on-bit. At least one PDC cutting element, configured according to any of the previously described PDC embodiments (e.g., the PDC 100 shown in FIG. 1A-1D), may be affixed to the bit body 1502. With reference to FIG. 15B, a plurality of PDCs 1512 are secured to the blades 1504. For example, each PDC 1512 may include a PCD table 1514 bonded to a substrate 1516. More generally, the PDCs 1512 may comprise any PDC disclosed herein, without limitation. In addition, if desired, in some embodiments, a number of the PDCs 1512 may be conventional in construction. Also, circumferentially adjacent blades 1504 define so-called junk slots 1518 therebetween, as known in the art. Additionally, the rotary drill bit 1500 may include a plurality of nozzle cavities 1520 for communicating drilling fluid from the interior of the rotary drill bit 1500 to the PDCs 1512.

The PCD elements and/or PDCs disclosed herein (e.g., the PDC 100 shown in FIG. 1A-1D) may also be utilized in applications other than rotary drill bits. For example, the disclosed PDC embodiments may be used in thrust-bearing assemblies, radial bearing assemblies, wire-drawing dies, artificial joints, machining elements, and heat sinks.

FIG. 16 is an isometric cutaway view of an embodiment of a thrust-bearing apparatus 1600, which may utilize any of the disclosed PDC embodiments as bearing elements. The thrust-bearing apparatus 1600 includes respective thrust-bearing assemblies 1602. Each thrust-bearing assembly 1602 includes an annular support ring 1604 that may be fabricated from a material, such as carbon steel, stainless steel, or another suitable material. Each support ring 1604 includes a plurality of recesses (not labeled) that receives a corresponding bearing element 1606. Each bearing element 1606 may be mounted to a corresponding support ring 1604 within a corresponding recess by brazing, press-fitting, using fasteners, or another suitable mounting technique. One or more, or all of bearing elements 1606 may be configured according to any of the disclosed PDC embodiments. For example, each bearing element 1606 may include a substrate 1608 and a PCD table 1610, with the PCD table 1610 including a bearing surface 1612.

In use, the bearing surfaces 1612 of one of the thrust-bearing assemblies 1602 bears against the opposing bearing surfaces 1612 of the other one of the bearing assemblies 1602. For example, one of the thrust-bearing assemblies 1602 may be operably coupled to a shaft to rotate therewith and may be termed a "rotor." The other one of the thrust-bearing assemblies 1602 may be held stationary and may be termed a "stator."

FIG. 17 is an isometric cutaway view of an embodiment of a radial bearing apparatus 1700, which may utilize any of the disclosed PDC embodiments as bearing elements. The radial bearing apparatus 1700 includes an inner race 1702 positioned generally within an outer race 1704. The outer race 1704 includes a plurality of bearing elements 1710 affixed thereto that have respective bearing surfaces 1712. The inner race 1702 also includes a plurality of bearing elements 1706 affixed thereto that have respective bearing surfaces 1708. One or more, or all of the bearing elements 1706 and 1710 may be configured according to any of the PDC embodiments disclosed herein. The inner race 1702 is positioned generally within the outer race 1704 and, thus, the inner race 1702 and outer race 1704 may be configured so that the bearing surfaces 1708 and 1712 may at least partially contact one another and move relative to each other as the inner race 1702 and outer race 1704 rotate relative to each other during use.

The radial-bearing apparatus 1700 may be employed in a variety of mechanical applications. For example, so-called "roller cone" rotary drill bits may benefit from a radial-bearing apparatus disclosed herein. More specifically, the inner race 1702 may be mounted to a spindle of a roller cone and the outer race 1704 may be mounted to an inner bore formed within a cone and that such an outer race 1704 and inner race 1702 may be assembled to form a radial-bearing apparatus.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a substrate; and a polycrystalline diamond table bonded to the substrate, the polycrystalline diamond table including a plurality of diamond grains bonded together that define a plurality of interstitial regions, at least a portion of the plurality of interstitial regions including at least one catalyst disposed therein, the polycrystalline diamond table including an upper surface including one or more recesses extending inwardly therefrom to a selected depth, the one or more recesses at least partially filled with one or more sacrificial materials, wherein the one or more sacrificial materials are substantially free of the at least one catalyst;

wherein the one or more sacrificial materials include a plurality of stacked discs, at least some of the plurality of stacked discs exhibiting different lateral dimensions.

2. The polycrystalline diamond compact of claim 1, wherein the polycrystalline diamond table includes one or more channels extending from the one or more recesses.

3. The polycrystalline diamond compact of claim 2, wherein the one or more channels extend from a vertex of the one or more recesses.

4. The polycrystalline diamond compact of claim 1, wherein the selected depth that the one or more recesses extends is approximately a thickness of the polycrystalline diamond table.

5. The polycrystalline diamond compact of claim 1, wherein the selected depth that the one or more recesses extend is less than a thickness of the polycrystalline diamond table.

6. The polycrystalline diamond compact of claim 1, wherein the one or more recesses is located off center on the polycrystalline diamond table.

7. The polycrystalline diamond compact of claim 1, wherein the one or more recesses exhibit, in plan view, a generally rectangular geometry, a generally circular geometry, a generally triangular geometry, or a generally star-shaped geometry.

8. The polycrystalline diamond compact of claim 1, wherein the one or more recesses include at least one sidewall, the at least one sidewall exhibiting a generally stepped-type geometry, a generally vertical geometry, a generally tapered geometry or a generally curved geometry.

9. The polycrystalline diamond compact of claim 1, wherein the one or more recesses includes an annular recess.

10. The polycrystalline diamond compact of claim 1, wherein the one or more recesses form a network of recesses that separate a plurality of protrusions.

11. The polycrystalline diamond compact of claim 1, wherein the one or more recesses exhibit a decreasing diameter with increasing distance from the substrate.

12. The polycrystalline diamond compact of claim 1, wherein the substrate includes a non-planar interface and the polycrystalline diamond table exhibits a geometry that generally contours the non-planar interface of the substrate.

13. The polycrystalline diamond compact of claim 1, wherein the one or more recesses exhibit a geometry that functions to preferentially initiate crack propagation at selected regions of the polycrystalline diamond table.

14. The polycrystalline diamond compact of claim 1, wherein the one or more sacrificial materials include at least one of one or more refractory metal materials, or one or more ceramics.

15. The polycrystalline diamond compact of claim 1, wherein the polycrystalline diamond table is leached to remove at least one infiltrant material from a portion thereof.

16. The polycrystalline diamond compact of claim 1, wherein the one or more recesses comprise about 30% to about 45% by volume of the polycrystalline diamond table.

17. The polycrystalline diamond compact of claim 1, wherein the polycrystalline diamond table includes a plurality of diamond grains that are directly bonded to each other to define a plurality of interstitial regions therebetween, wherein at least some of the one or more sacrificial materials at least partially occupy at least some of the plurality of interstitial regions.

18. The polycrystalline diamond compact of claim 1, wherein the upper surface forms a substantially planar surface.

19. The polycrystalline diamond compact of claim 16, wherein the one or more sacrificial materials substantially completely fills the one or more recesses.

20. A polycrystalline diamond compact, comprising:

a substrate; and a polycrystalline diamond table bonded to the substrate, the polycrystalline diamond table including a plurality of diamond grains bonded together that define a plurality of interstitial regions, at least a portion of the plurality of interstitial regions including at least one catalyst disposed therein, the polycrystalline diamond table including an upper surface and one or more sacrificial materials that are substantially free of the at least one catalyst, the one or more sacrificial materials defining one or more recesses and one or more channels extending from at least one of the one or more recesses, the one or more recesses and the one or more channels comprise about 30% to about 80% by volume of the polycrystalline diamond table;

wherein the one or more sacrificial materials include a plurality of stacked discs, at least some of the plurality of stacked discs exhibiting different lateral dimensions.

21. The polycrystalline diamond compact of claim 20, wherein the one or more recesses and the one or more channels comprise about 30% to about 45% by volume of the polycrystalline diamond table.

22. The polycrystalline diamond compact of claim 1, wherein the one or more sacrificial materials consist essentially of one or more refractory metal materials.

23. The polycrystalline diamond compact of claim 1, wherein the one or more sacrificial materials consist essentially of one or more ceramics.

24. The polycrystalline diamond compact of claim 23, wherein the one or more ceramics include hexagonal boron nitride, silicon carbide, aluminum oxide, or combinations thereof.

25. The polycrystalline diamond compact of claim 1, wherein at least one of the one or more recesses includes at least one surface exhibiting a stepped geometry.

26. The polycrystalline diamond compact of claim 1, wherein the plurality of stacked discs form a solid body.

27. The polycrystalline diamond compact of claim 1, wherein the different lateral dimensions are different diameters.

28. A polycrystalline diamond compact, comprising:

a substrate; and a polycrystalline diamond table bonded to the substrate, the polycrystalline diamond table including a plurality of diamond grains bonded together that define a plurality of interstitial regions, at least a portion of the plurality of interstitial regions including at least one catalyst disposed therein, the polycrystalline diamond table further including an upper surface including one or more recesses extending inwardly therefrom to a selected depth, the one or more recesses at least partially filled with one or more sacrificial materials;

wherein the one or more sacrificial materials are substantially free of the at least one catalyst;

wherein the one or more recesses exhibit a decreasing diameter with increasing distance from the substrate.

* * * * *